US006525270B1

(12) United States Patent
Connor et al.

(10) Patent No.: US 6,525,270 B1
(45) Date of Patent: Feb. 25, 2003

(54) COMPRESSION CONNECTOR

(75) Inventors: Brian W. Connor, Amherst, NH (US); Gary W. Di Troia, Brookline, NH (US); Henry T. Nelson, Bedford, NH (US)

(73) Assignee: FCI USA, Inc., Etters, PA (US)

( * ) Notice: Subject to any disclaimer, the term of this patent is extended or adjusted under 35 U.S.C. 154(b) by 0 days.

(21) Appl. No.: 09/687,863

(22) Filed: Oct. 13, 2000

(51) Int. Cl.[7] ..... H01R 4/00
(52) U.S. Cl. ..... 174/84 C; 174/94 R
(58) Field of Search ..... 174/84 R, 84 C, 174/94 R, 74 R, 71 R; 439/877

(56) References Cited

U.S. PATENT DOCUMENTS

| | | | | | |
|---|---|---|---|---|---|
| 2,707,775 | A | * | 5/1955 | Hoffman et al. | 339/276 |
| 2,956,108 | A | * | 10/1960 | Brenner | 174/94 |
| 3,183,025 | A | * | 5/1965 | Lynch, Jr. et al. | 287/78 |
| 3,322,888 | A | * | 5/1967 | Zemels | 174/94 |
| 3,354,517 | A | * | 11/1967 | Levinsky | 24/123 |
| 3,781,459 | A | * | 12/1973 | Peek | 174/94 R |
| 5,036,164 | A | * | 7/1991 | Schrader et al. | 174/94 R |
| 5,103,068 | A | * | 4/1992 | Schrader | 174/94 R |
| 5,162,615 | A | | 11/1992 | Schrader et al. | 174/94 |
| 5,200,576 | A | | 4/1993 | Schrader et al. | 174/94 |
| 5,396,033 | A | * | 3/1995 | Piriz et al. | 174/94 R |
| 5,552,564 | A | * | 9/1996 | Schrader et al. | 174/84 C |
| 5,635,676 | A | * | 6/1997 | Piriz | 174/84 C |
| 5,898,131 | A | | 4/1999 | Chadbourne et al. | 174/84 |

* cited by examiner

*Primary Examiner*—Chau N. Nguyen
*Assistant Examiner*—William H. Mayo, III
(74) *Attorney, Agent, or Firm*—Harrington & Smith, LLP

(57) ABSTRACT

An electrical compression connector adapted to be deformed in a crimping device. It includes a body of compressive material. The connector has a central body member having top and bottom portions and two side portions. At least one pair of opposed parallel arms extend from the top or bottom portions of the central body member. Each pair of arms define a U shape opening adapted to allow for the inclusion of conductors therein. At least one of the side portions includes at least one side opening to allow for the inclusion of conductors. Each of the side openings includes an inner surface having both a curved surface and a substantially straight linear surface. When a compressive force is applied by the crimping device to the connector, the connector body compresses, thereby compressing the connector body around the conductors. The conductors are completely and firmly secured within each of the openings whereby all portions of the conductors remain positioned in the openings during crimping.

16 Claims, 3 Drawing Sheets

COMPRESSION CONNECTOR

BACKGROUND OF THE INVENTION

1. Field of the Invention

The present invention basically relates to electrical compression connectors for single strand or multistrand wire or one or more cable conductors or possibly an array of different size cable combinations. More specifically, the present invention relates to compression-type electrical connectors having a unique geometric configuration for connecting a plurality of relatively finer gage conductors together.

2. Brief Description of Prior Art

Prior art compressible connectors are known in which a plurality of wires are positioned in a single connector. However, several of the various designs for these connectors present issues with containing relatively fine stranded type conductors in the openings for such conductors when the connector is subject to compression, i.e. When subjecting this type of connector to a crimping operation. When the connector is subject to compression, the run locations of the connector almost completely close before the tap ports in the connector start to collapse. In view of the geometry of current compression connector designs, the ports in such connectors cannot contain all of the strands of the conductors during compression of the connector. The end result is that many of the conductor strands are forced out through the opening ports in the connector leaving only a percentage of the conductors actually being captured in the connector after the compression process is complete.

It has been found that in many designs for compression type connectors, during the crimping process in which the connector is subject to compression, the main run port was almost completely closed before the tap ports started to compress. This time delay between the run ports and tap ports position closure causes the flexible conductors that are positioned in these ports to fan outwards, resulting in a large percentage of the conductor strands being forced outside of the ports.

In accordance with the features of the present invention each port within the connector housing has a geometry which includes an inner surface combining both a curved surface and a substantially linear surface extending from the curved surface, i.e. both the top and run ports.

SUMMARY OF THE INVENTION

The present invention overcomes the deficiencies of prior art connectors by providing a compression connector that has both tap type ports having a new geometry so as to delay the compression of the flexible conductors in the tap ports while the tap ports close and seal off the openings through which conductor strands would normally escape during the crimping or compression process. Due to the timing of the collapse of the different ports in the connector during the compression process, the shape of the tap ports play a significant role in the success of the connector to capture the strands of the conductor during compression, particularly fine conductor strands.

In accordance with the features of the present invention the disadvantages of prior art connectors as described above are overcome by an electrical compression connector adapted to be deformed by a crimping device, including a body of compressive material, the connector comprising a central body member having top and bottom portions and two side portions; at least one pair of opposed parallel arms extending from the top or bottom portions of the central body member, each pair of arms defining a U shape opening adapted to allow for the inclusion of conductors therein; and at least one of said portions including at least one side opening to allow for the inclusion of conductors each of the side openings including an inner surface comprising both a curved surface and a substantially straight linear surface whereby when a compressive force is applied by the crimping device to the connector, the connector body will compress thereby compressing the connector body around the conductors whereby the conductors are completely and firmly secured within each of the openings such that all portions of the conductors remain positioned in the openings during the crimping process.

The present invention overcomes the deficiencies of prior art connectors by providing a compression connector having openings (i.e. ports or recesses or channels, etc.) for the positioning of multiple independent conductors, which connectors can be crimped by a single tool stroke by standard crimping tools. The particular geometry of the connectors of the present invention optimizes and localizes the force output of the crimping tool to efficiently close the ports of the connector in such a manner due to each port within the connector having a particular geometry, i.e. both a curved surface and a substantially straight surface projecting from the curved surface. Due to the timing of the collapse of the different areas of the connector, the shape (i.e. geometry) of the tap openings play a significant role in the success of the connector being able to capture all of the fine conductor strands during compression.

In accordance with the features of the present invention, when the connector is subject to a compressive force, in view of the geometry of all the ports, all of the ports will close together, i.e. at the same time; thereby preventing conductor strands from being forced out of the openings during crimping.

BRIEF DESCRIPTION OF THE DRAWINGS

The foregoing and other objects and advantages of the present invention will be better understood with reference to the following detailed description of preferred embodiments thereof, which are illustrated, by way of example, in the accompanying drawings, wherein:

FIG. 4 is an end elevational view of the second embodiment of the present invention as illustrated in

FIG. 2;

DETAILED DESCRIPTION OF THE INVENTION

Figure 1:
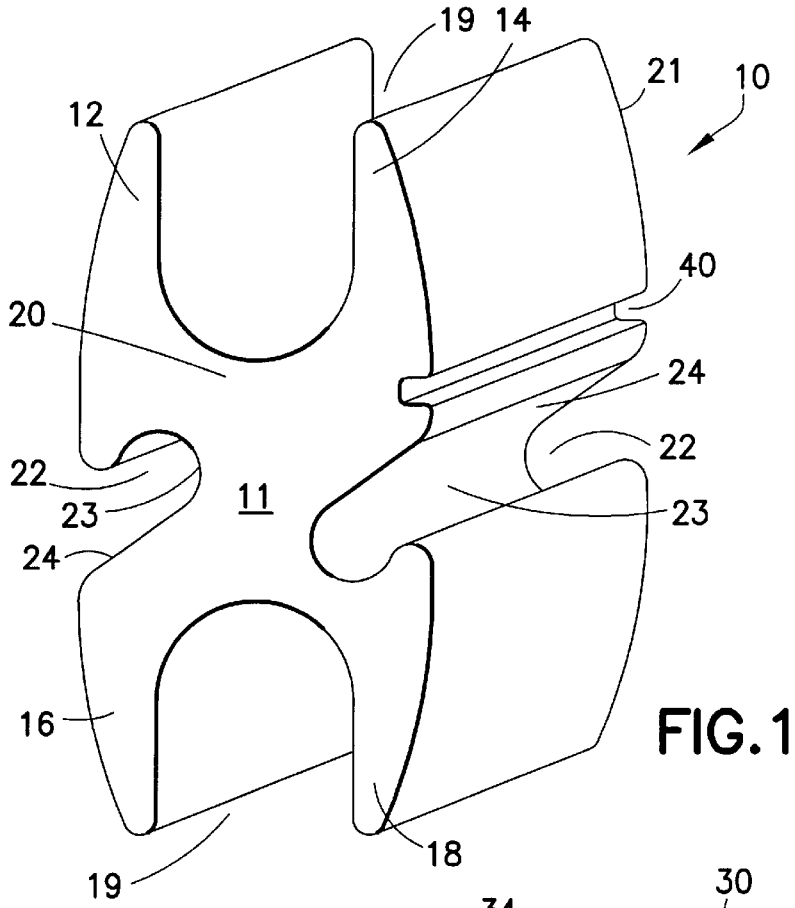
FIG. 1 is a perspective view of a first embodiment of the present invention.

Although the present invention will be described with reference to the embodiments shown in the drawings, it should be understood that the present invention can be embodied in many alternate forms of embodiments. In addition, any suitable equivalent size, shape or type of elements or materials could be used.

Figure 3:
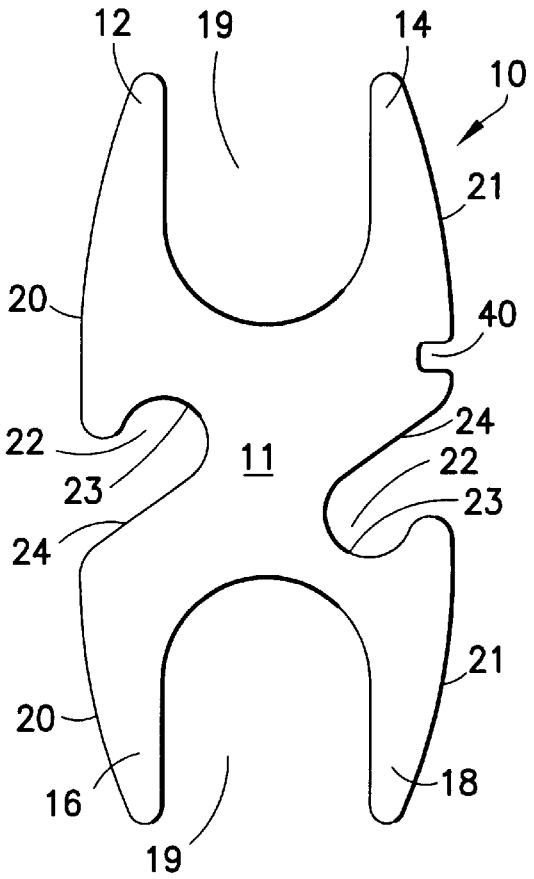
FIG. 3 is an end elevational view of the first embodiment of the present invention as illustrated in FIG. 1.

Referring to FIGS. 1 & 3 there is shown a first embodiment of a connector incorporating the features of the present invention. FIGS. 1 & 3 illustrate a compressible connector 10 having a main body in the form of a central body member 11. The connector, in accordance with the features of the present invention, is preferably manufactured from a compressible material such as, for example, tin-plated copper, aluminum or any other similar metallic materials which would appropriately deform when pressure is applied in a standard mechanical, hydraulic and pneumatic crimping devices.

Figure 5:
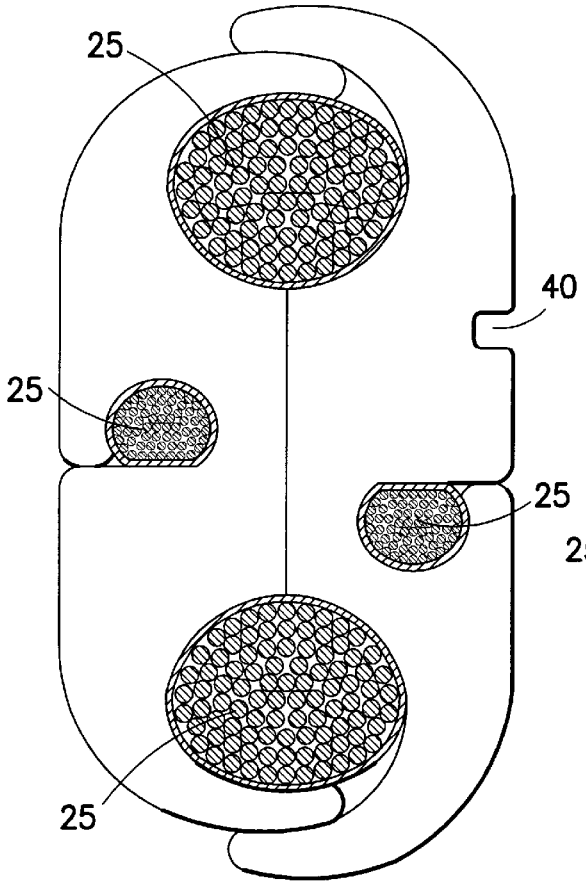
FIG. 5 is an end elevational view of the first embodiment of the present invention as illustrated in FIG. 1 having conductors in place and illustrating the connector after the crimping process, the connector having overlapping arms.

The first embodiment illustrated in FIGS. 1 and 3 is a connector 10 that includes at least two substantially parallel arms 12 and 14 extending from the main body portion 11. The preferred embodiment, in accordance with the features of the present invention is formed in generally an H shape whereby the connector includes a second pair of substantially parallel arms 16 and 18 extending from an end portion of connector 10, i.e. extending opposite to the arms 12 and 14 such that arms 12 and 14, and arms 16 and 18 both each define a U shape opening or port 19, i.e. a run port (i.e. a port having an inner surface including both a curved surface and a substantially straight linear surface extending from the curved surface, i.e. a U shape) adapted to allow for the inclusion of various sized wires or conductors provided within each of these recess portions or ports 19. Positioned at each side portion of connector 10 is a side opening or port (i.e. a tap port) to allow for the inclusion of conductors. As shown in the embodiment illustrated in FIGS. 1 and 3 each side portion 20 and 21 of conductor 10 includes at least one side opening or port 22 to allow for the inclusion of conductors. Each of the openings 22 include an inner surface comprising both a curved surface 23 and a substantially straight linear surface 24 extending from the linear surface whereby when a compressive force is applied by a crimping device on connector 10, the connector body will compress thereby compressing the connector body around conductors 25 (see FIG. 5) such that all conductors positioned in the openings during the crimping process will remain in the openings during crimping. In view of the advantages of the present invention over the prior art i.e. in view of the geometry of the connector ports which hold the conductors in the ports during crimping, connectors which incorporate the features of the present invention do not have problems with containing extremely fine stranded flexible conductors. In fact, by employing connectors in accordance with the features of the present invention connectors can be subject to a crimping process with up to class K type conductors in each port, and avoid the problem of containing this size conductor in the connector ports during compression (i.e. crimping).

In accordance with the features of prior art connectors, once any conductor wire finer than a class I type conductor is placed in the port of a connector, and the connector is subject to a crimping process, typically the end result is that a large percentage of the strands are forced outside of the ports during the crimping process.

Figure 2:
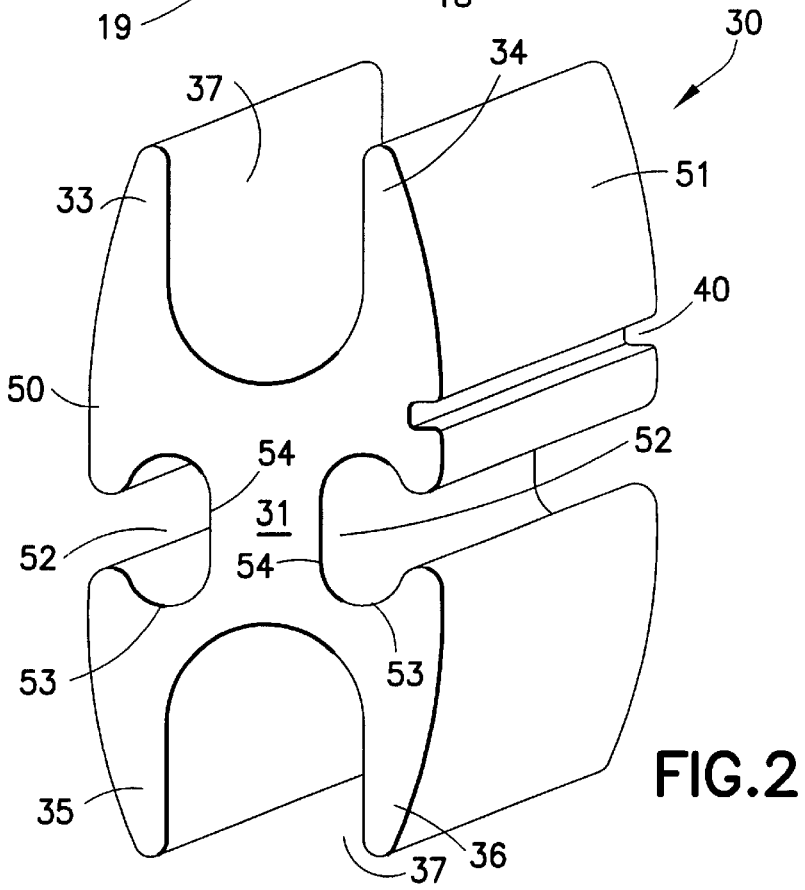
FIG. 2 is a perspective view of a second embodiment of the present invention.
Figure 4:
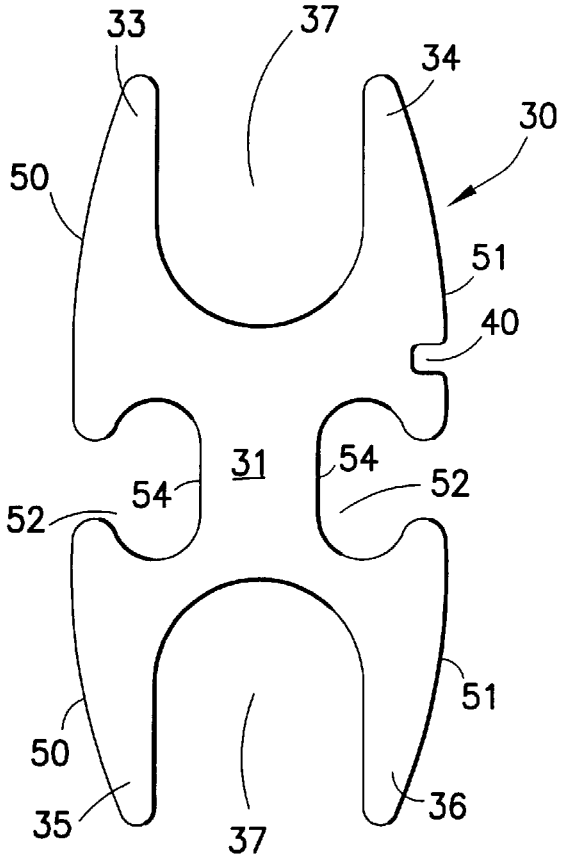
Figure 6:
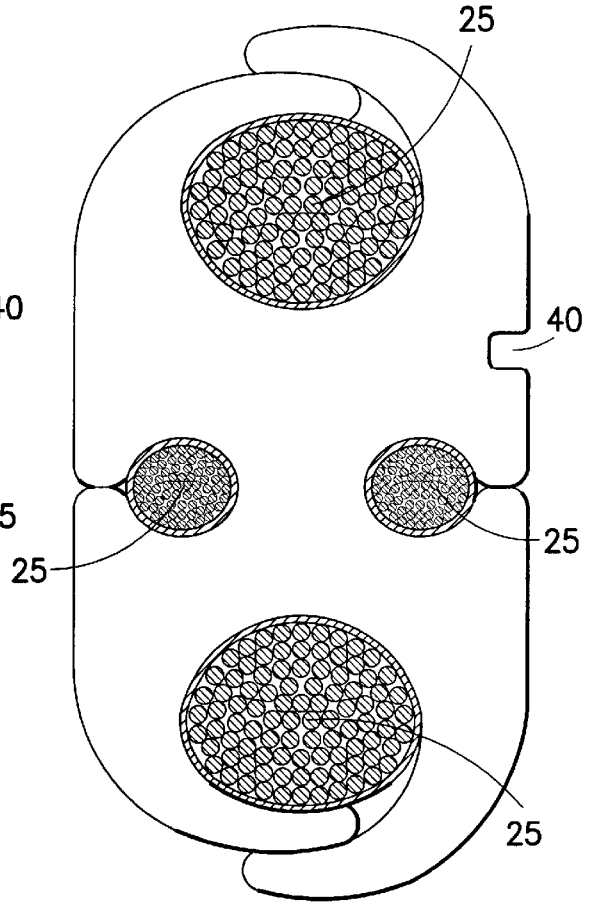
FIG. 6 is an end elevational view of the second embodiment of the present invention as illustrated in FIG. 2 having conductors in place and illustrating the connector after the crimping process, the connector having overlapping arms.

Referring to FIGS. 2 and 4 there is shown a second embodiment of a connector incorporating the features of the present invention. FIGS. 2 and 4 illustrate a second embodiment of a compressible connector 30 having a main body in the form of a central body member 31. The connector includes at least two substantially parallel arms 33 and 34 extending from the main body. In accordance with the preferred features of the present invention, the connector is formed in generally an H shape whereby connector 30 further includes a second pair of substantially parallel arms 35 and 36 extending from an end portion of connector 30 i.e. extending opposite to the arms 33 and 34 such that both arms 35 and 36 and arms 33 and 34 each define a U shape opening or port 37 (i.e. a port having an inner surface including both a curved surface and a substantially straight linear surface extending from the curved surface, e.g. a U shape) adapted to allow for the inclusion of various sized wires or conductors provided within each of these recess portions or ports 37. Each port 37 (i.e. a run port) is adapted is provide space for the positioning of conductors 25 (see FIG. 6) such that when a compressive force is applied by a crimping device to the connector, the connector body will compress thereby compressing the connector body around the conductors 25 such that all the conductors (especially extremely fine conductors such as, for example, anything up to a class K type conductor) are completely and firmly secured within each of the ports 37 whereby all portions of the conductors remain in the openings during and after the crimping process. When placed in a standard crimping tool having die surfaces, connector 10 or 30 would come into contact with the interior surfaces of the dies. The crimping tool, as a compressive force is applied, will come into contact with the die surfaces, and the conductors provided in ports will receive direct compressive loads due to the unique geometric relationship between the connector and the die. After the crimping process is terminated, conductors provided in these ports would be secured in place without any of the strands of the conductors being forced outside of the openings during the crimping process (see FIG. 5 and 6).

As shown in the embodiment illustrated in FIGS. 2 and 4 each side portion 50 and 51 of conductor 30 includes at least one side opening or port 52 to allow for the inclusion of conductors. Each of the openings 52 include an inner surface comprising both a curved surface 53 and a substantially straight linear surface 54 extending from the linear surface whereby when a compressive force is applied by a crimping device on connector 30, the connector body will compress thereby compressing the connector body around conductors 25 (see FIG. 6) such that all conductors positioned in the openings during the crimping process will remain in the openings during crimping.

Connector 10 and 30 have one or more surfaces of the connector provided with an extruded groove 40 having a tying device press-fitted therein. After conductors are inserted into the various ports of the connector, the tying device would be tied or twisted around each end of the conductor bundles prior to implementing the crimping process. A holding and tying device, such as an elongated piece of wax covered twine, is secured into the groove 40 and extends for a sufficient length to be tied around the various conductors.

As described above, the connector according to the features of the present invention contains openings which can be described as ports or recesses or slots or channels, these are provided to accommodate one or more single strand or multi-strand conductors or cables. Surfaces are provided in the interior of the respective ports to accommodate the various conductors. Although the connector in accordance with the present invention can be provided with differently-sized ports this need not be the case, and these ports can be of equal dimension. Additionally, the connector illustrated in the figures can be used with various ranges or sizes of conductors or cables. However, in accordance with the specific advantages of the present invention as described above, these connectors exhibit particular advantages when used with very fine conductor wires, e.g. Class K type conductors.

It should be understood that the foregoing description is only illustrative of the present invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical compression connector adapted to be deformed in a crimping device, including a connector body of compressive material, said connector body comprising:

(i) a central body member having top and bottom portions and two side portions;

(ii) at least one pair of opposed parallel arms extending from said top or bottom portions of said central body member to respective free ends of said arms, each of said arms as measured from its respective top or bottom portion of said central body member to its respective free end having a generally equal length, each pair of arms defining a U shape opening adapted to allow for the inclusion of conductors therein; and (iii) at least one of said side portions including a side opening to allow for the inclusion of conductors, each of said side openings including an inner surface comprising both a curved surface and a substantially straight linear surface, wherein a cross section of each of said side openings has a curved section and a substantially straight linear section tangential to said curved section, whereby when a compressive force is applied by said crimping device to said connector, said connector body will compress thereby compressing said connector body around said conductors;

whereby each of said conductors are completely and firmly secured within its respective U-shape or side openings, such that all portions of said conductors in said side openings remain positioned in said side openings during crimping.

2. An electrical connector as in claim 1 wherein each of said side openings extend from said side portions inwardly on said connector.

3. An electrical connector as in claim 1 wherein each of said side openings is oval shaped.

4. An electrical connector as in claim 1 wherein each of said side openings include a circular surface and an inclined straight leg member extending from said circular surface.

5. An electrical connector as in claim 4 wherein each of said leg members are substantially equal in length.

6. An electrical connector as in claim 1 wherein said connector is extruded.

7. An electrical connector as in claim 1 further including a groove positioned on one of said side portions, said groove adapted to have a tying device positioned therein.

8. An electrical connector as in claim 7 further including a tying device positioned in said groove of sufficient length to be twisted around one or more of said conductors prior to crimping.

9. An electrical connector as in claim 8 wherein said tying device is a metallic wire.

10. An electrical connector as in claim 8 wherein said tying device is a wax covered twine.

11. An electrical connector as in claim 1 wherein each of said openings are formed to a configuration adapted to receive therein conductors of varying cross-section dimension.

12. An electrical connector as in claim 1 wherein each of said curved surfaces is part of a circle.

13. An electrical connector as in claim 12 wherein the diameter of each circle is equal to one another.

14. An electrical connector as in claim 1 wherein each of said conductors are fine stranded flexible conductors.

15. An electrical connector as in claim 1 wherein said body of compressive material is formed in a generally H shape.

16. An electrical compression connector adapted to be deformed in a crimping device, including a body of compressive material formed in generally an H shape, said connector comprising:

(i) a central body member having top and bottom portions and two side portions;

(ii) first and second pairs of opposed parallel legs extending from said top and bottom portions of said central body member to respective free ends of said arms, each of said arms as measured from its respective top or bottom portion of said central body member to its respective free end having a generally equal length, each of said first and second pairs of legs defining U shape openings whereby each are adapted to allow for the inclusion of conductors therein; and (iii) each of said side portions including a side opening to allow for the inclusion of a conductor, each of said aide openings including an inner surface comprising both a curved surface and a substantially straight linear surface such that a cross section of each of said side openings has a curved portion and a substantially straight portion tangential to said curved portion;

whereby when a compressive force is applied by said crimping device to said connector, said connector body will compress thereby compressing said connector body around said conductors whereby each of said conductors are completely and firmly secured within its respective U-shape or side openings such that all portions of said conductors in said side openings remain positioned in said side openings during crimping.

* * * * *